United States Patent [19]

Gramza et al.

[11] Patent Number: 4,843,651

[45] Date of Patent: Jul. 4, 1989

[54] WRIST SUPPORT GLOVE

[75] Inventors: Fred L. Gramza, Saugus; Robert J. Hatch, Carpinteria, both of Calif.

[73] Assignee: Hatch Imports, Inc., Ventura, Calif.

[21] Appl. No.: 142,200

[22] Filed: Jan. 11, 1988

[51] Int. Cl.[4] ..... A41D 19/00

[52] U.S. Cl. ..... 2/161 A; 2/163

[58] Field of Search ..... 2/161 R, 161 A, 159, 2/162, 163, 167, 170, 19

[56] References Cited

U.S. PATENT DOCUMENTS 4,400,831 8/1983 Rietz ..... 2/161 A 4,525,877 7/1985 Chong ..... 2/161 A 4,701,963 10/1987 Overton ..... 2/161 A 4,720,279 1/1988 Fritschen et al. ..... 2/161 A

*Primary Examiner*—Henry S. Jaudon

*Attorney, Agent, or Firm*—Marvin E. Jacobs

[57] ABSTRACT

The wrist support glove includes a length of breathable, stretchable material attached to a rear edge of a glove, preferably at an angle from 60 to 80 degrees. The material is stretched and revolved around the wrist to form a support wrap. The outer surface of the wrap contains loops and the outer surface is provided with a patch of Velcro-type hook fastener which is engaged with the loops to form a variable positionable fastener.

15 Claims, 2 Drawing Sheets

WRIST SUPPORT GLOVE

TECHNICAL FIELD

The present invention relates to gloves and, more particularly, this invention relates to an athletic glove including support and protection for the wrist of the user.

BACKGROUND OF THE INVENTION

Weight lifting has become a widely practiced activity for both men and women. In addition to being a sport in itself, weight lifting is utilized by many as a conditioning and strengthening exercise for other sports such as football, basketball, basketball, tennis, etc. Athletes who mainly rely on agility, such as tennis players, also benefit from weight lifting.

As in other sports, protective equipment is utilized to prevent injury to the participant. In weight lifting, the bar that carries the weights is roughened or knurled to prevent slippage. This can cause excessive roughening of the palms of the lifter. Many weight lifters wear gloves to protect their palms. This also provides a surer grip in case sweat develops on the palms of the lifter's hands. Gloves also minimizes development of blisters.

All the joints of the body are subjected to extreme forces during weight lifting. Many lifters use elastic wraps or Ace bandages on their joints for support. Knee and wrist wraps are sanctioned by the regulating authorities subject to restrictions as to length, width and placement of the wrap.

Wrist bands cannot exceed 10 cms in width. The wrist bands may be a wrap around style having a thumb loop on one end and a fastener, such as a Velcro patch, on the other end. However, the thumb loop cannot be over the thumb during the actual lift. The flap of material containing the thumb loop can interfere with the grip of the bar.

Wrist wraps cannot exceed 1 meter in length and 8 cm in width and cannot exceed 12 cm in width when wrapped onto the wrist. Wrist wraps are difficult to apply since the first edge slips until secured by at least one revolution of taut fabric. This requires use of the other hand to hold the wrap while also revolving the wrap—a difficult maneuver to accomplish.

Wrist bands, thumb loop wraps or regular wraps require carrying separate gloves and wraps with the possibility of losing, misplacing or forgetting one of the four pieces of equipment.

STATEMENT OF INVENTION

An easily applied wrist wrap is provided by the present invention. The wrap is always in proper orientation for wrapping a wrist and does not require use of the other hand for securing the starting end.

The wrist wrap of the invention comprises a length of stretchable wrap material secured to the inner edge of a glove approximately along the edge of the wrist at an angle approximately in line with the outer edge of the thumb in its free, relaxed position. The wrap is readily revolved tightly around the wrist to form a firm support. The leading edge of the wrap material conforms to the wrist without causing any creases or bulking of the material.

The outer end of the wrap material includes a fastener, preferably a patch of Velcro-type hook fastener that attaches to the loop fabric provided on the top surface of the wrap.

The wrap is convenient to carry since the glove and wrist support are connected and cannot be separated or lost. The extra patch of material extending below the glove provides abrasion protection for the inner and outer surfaces of the wrist, especially when the glove-wrap assembly is used in other activities such as roller skating, biking or motorcycle racing. A principal advantage of the wrist support glove of the invention is the ready ability to apply the wrist wrap with the use of the other hand and the automatic positioning of the starting portion of the wrap in the correct disposition of the wrist.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
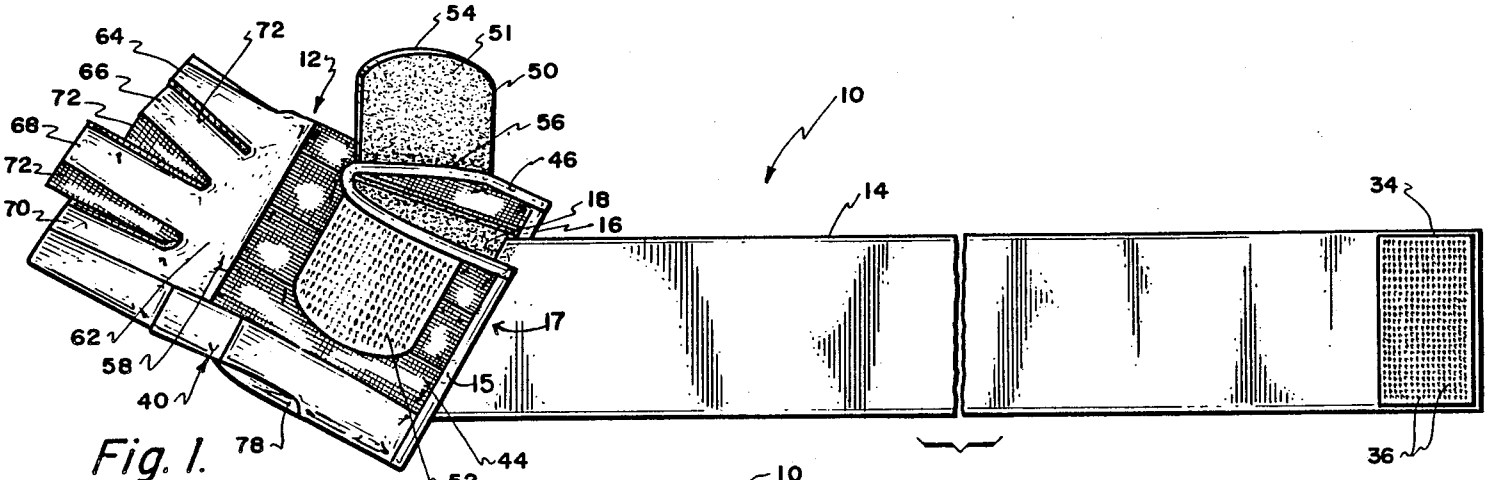
FIG. 1 is a front view in elevation of a protective glove in accordance with the invention.
Figure 2:
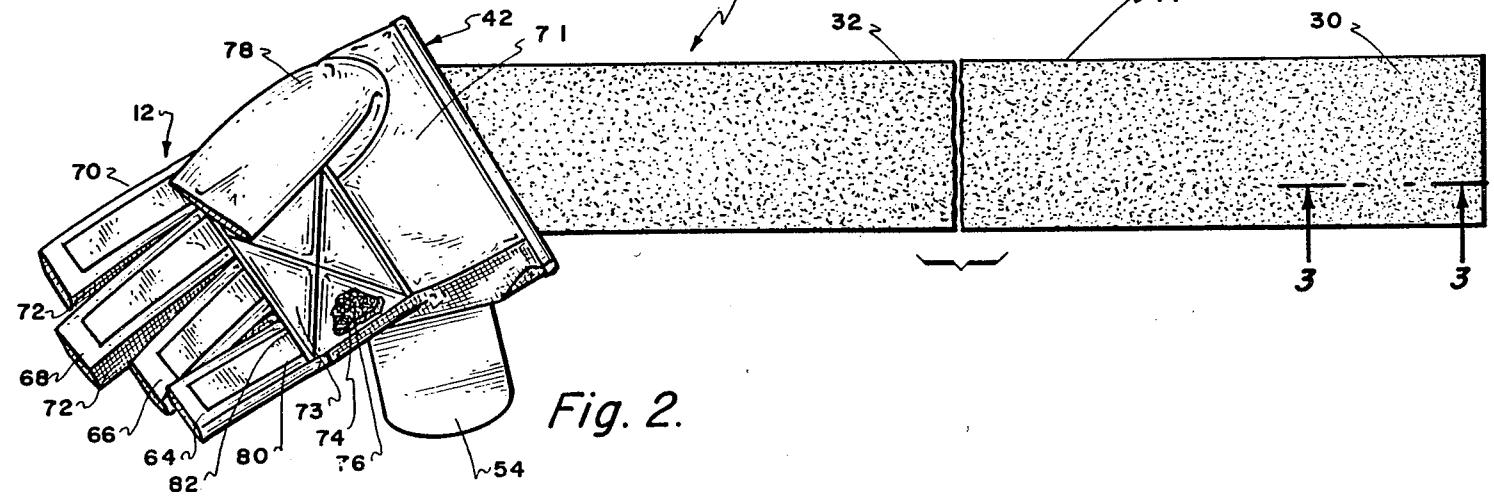
FIG. 2 is a rear view in elevation of the glove shown in FIG. 1.
Figure 3:
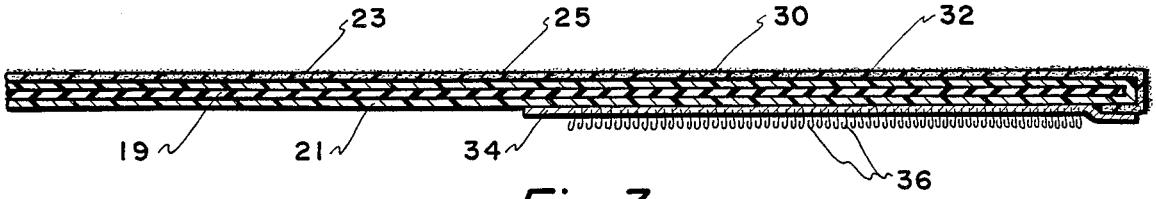
FIG. 3 is a view in section taken along line 3—3 of FIG. 2.

Referring now to FIGS. 1–3, the glove 10 of the invention includes a forward glove section 12 having a length of elastic fabric wrap 14 is attached to an inner edge 16 of a rear opening 17 of the glove section 12. The wrap can be attached to the inner edge 16 or outer edge 19 of the glove opening. It is more comfortable to attach the wrap to the inner edge of the glove opening. The first end edge 18 of the wrap 14 is attached to the inner edge 16 of the glove opening at an angle between 60° and 80° with one edge of the glove generally positioned along a line of the little finger. The angle is preferably from 65° to 75°. At this angle, the wrap is positioned to address the wrist and wraps smoothly and evenly without bunching or wrinkling. The fabric is preferably rectangular though other configurations such as tapered or curved lengths of elastic can perform the support function. Usually the wrap will be formed of rectangular elastic having a width from 2 to 4 inches, typically about 3 inches.

The wrap should provide sufficient elasticity to provide adequate support but should not be too difficult to stretch. The degree of elasticity depends on the amount of weight to be lifted and the number of revolutions provided by the length of the wrap. The elasticity as measured by elongation is usually between 100 and 150 percent, preferably about 130–140 percent.

The length of the wrap is long enough to provide at least 2 revolutions of stretched material around the wrist. Usually no more than 5 revolutions are required in weight lifting or other activities during which the glove will be used. The unstretched wrap usually has a length from 1 to 3 feet.

The fabric can be rubber except that rubber does not breathe and is hard to fasten without causing it to tear. Preferred wrap materials are woven, breathable elastic materials. A preferred elastic includes filaments having a rubber core 19 covered with polyester 21. The fabric also includes stretch Nylon (polyamide) 23 and polyester threads 25. Specification for a 3 inch $\pm\frac{1}{8}$inch wide elastic fabric follows:

| | MATERIALS | No. of Ends |
|---|---|---|
| WARP | 150/2 Denier Textured Polyester | 148 |
| BACK WARP | 70/2 Denier Stretch Nylon | 75 |
| ELASTOMER CORE | 55 Gage Rubber | 78 |
| ELASTOMER COVER TOP | 20/1 Denier Spun Polyester | 1 |
| ELASTOMER COVER BOTTOM | 150/1 Denier Textured Polyester | 1 |
| FILLING | 150/2 Denier Textured Polyester 2 ends/pick | |
| ELONGATION (MANUAL) | 135% ± 10% (121–149) | |
| MATERIAL CONTENT | Nylon - 6% ± 3 (3–9) | |
| | Polyester - 82% ± 3 (79–85) | |
| | Rubber - 12% ± 3 (9–15) | |

The fabric is preferably woven to provide a bottom surface 30 with soft loops 32, at least along the last section of the wrap near the start of the final revolution. The wrap can be secured with any fastener such as pins, Ace bandage fasteners, hooks and eyes, snaps, etc. However, variable fastening is provided at any position by use of a patch 34 of Velcro-type hook fastener. When the hooks 36 engage the loops 32, a firm fastening of the wrap is achieved.

The glove 12 can be a conventional, full-fingered glove. However, weight lifters prefer gloves with ventilation and partial fingers to provide feel on the bar. As shown in FIGS. 1–3, the glove 12 is formed of a front panel 40 and a rear panel 42.

The front panel 40 includes a rear section 44 formed of a breathable, open-weave, elastic material such as Spandex. The panel contains a split seam 46 to permit expansion to receive a hand. The seam is closed with a set of fasteners, preferably a first tab 50 of hook fastener applied to the section 44 of woven elastic and a second tab 52 of loop material fastened to a leather facing 54 and sewn to the outer edge 56 of the seam 46 to form a live hinge. The top section 58 of the front panel 40 can be formed of a piece of leather having a base 62 attached to four partial finger facings 64, 66, 68, 70, usually from about $\frac{1}{2}$ to $\frac{3}{4}$ the length of fingers. The sides of the glove finger can be formed of three v-shaped, ventilated, elastic panels 72.

The rear panel 42 is designed to protect the user from abrasion. The palm section 71 contains an extra layer 73 of tough material such as leather, forming a pocket 74 which can be filled with padding 76 such as foam. A partial thumb cover 78 formed of reinforced leather projects from the edge of palm section 71. The finger section 80 is formed of a base 82 connected to four finger cover extensions formed of leather which can be formed with leather reinforcement.

Figure 4:
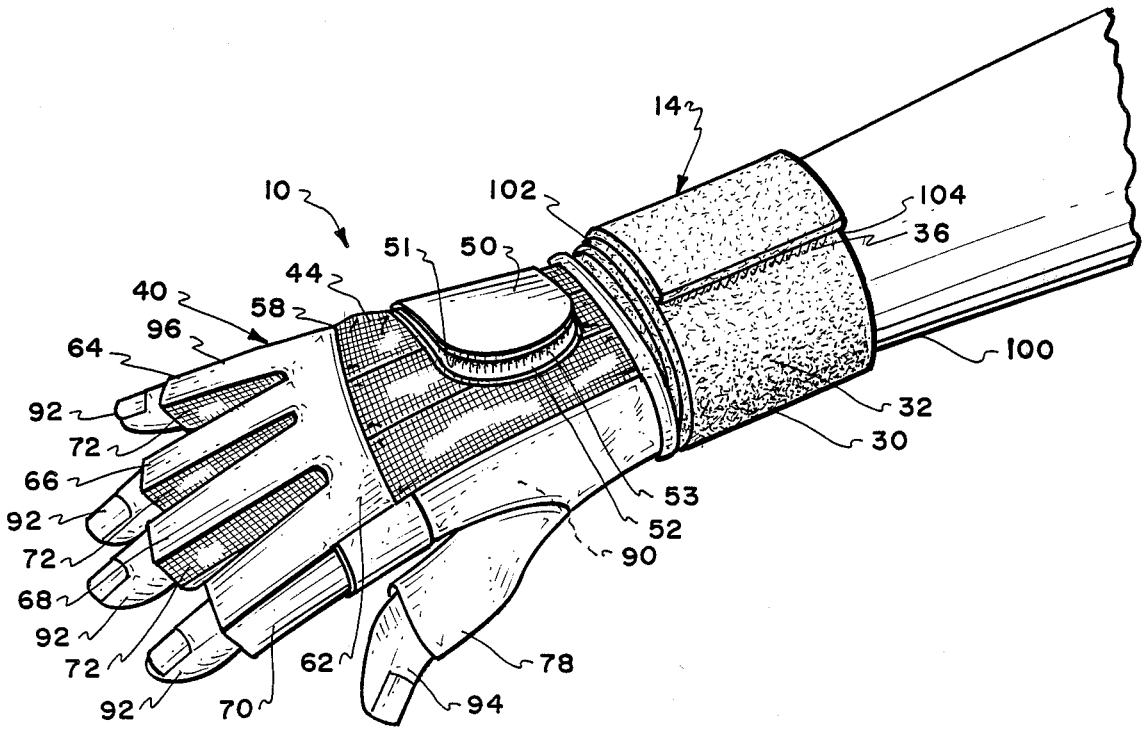
FIG. 4 is a perspective view showing the glove wrapped around the wrist of a user.

As shown in FIG. 4, the glove 10 is used by first opening the tab and seam and inserting a hand 90 until the fingers 92 and thumb 94 project from the partial fingers 96. The loops 51 on tab 50 are then secured to the hooks 53 on the tab 52. The wrap 14 is then grabbed between the thumb and fingers of the other hand about 5–6 inches from the edge of the glove and is stretched and wrapped around the wrist 100 of the user to form 2–3 revolutions 102. When the wrap is as tight as comfortable to the user, the hooks 36 on the Velcro patch 34 are is secured to the loops 32 on the fabric on bottom surface 30 of the wrap to form a fastened attachment 104.

The user then puts on a mirror image of the glove on the other hand and is ready to participate in weight lifting or other sport.

The glove of the invention could also find use industrially to support the wrist during carrying of heavy loads or when manipulating tools subjecting the wrist of the user to force or to torque.

Though the drawings illustrate the wrist wrap permanently attached to the glove by sewing, the wrist wrap could be attached to the glove by means of a set of cooperative fasteners such as a set of Velcro strips or a zipper.

It is to be realized that only preferred embodiments of the invention have been described and that numerous substitutions, modifications and alterations are permissible without departing from the spirit and scope of the invention as defined in the following claims.

We claim:

1. A wrist support glove comprising in combination:

a glove section formed of panels of material forming a hand covering having a rear opening for receiving the hand of the user, said rear opening having a set of inner and outer edges;

a wrap defined by a rectangular length of breathable elastic fabric sufficient to provide at least two circumferential wraps around the wrist of the user, the wrap having inner and outer opposite surfaces and first and second opposite end edges, the first end edge of the wrap being attached to the inner edge of the rear opening of the glove at an angle from 60 to 80 degrees; and means for fastening the second end edge of the wrap to the outer surface thereof.

2. A wrist support glove according to claim 1 in which the wrap has a width between 2 to 4 inches and an elongation of at least 100 percent.

3. A wrist support glove according to claim 2 in which the wrap is formed of a fabric comprising an elastomer core covered with woven fabric.

4. A wrist support glove according to claim 3 in which the fabric included a mixture of mixture of synthetic fibers.

5. A wrist support glove according to claim 4 in which the fibers include polyester and polyamide filaments.

6. A wrist support glove according to claim 3 in which the wrap fabric has an inner surface formed of woven loops.

7. A wrist support glove according to claim 6 in which the fastening means comprises a patch of hook fastener attached to the outer surface of the wrap fabric near the second edge thereof.

8. A wrist support glove comprising in combination:

a glove section formed of panels of material forming a hand covering having a rear opening for receiving the hand of the user, said rear opening having a set of inner and outer edges;

a wrap defined by a length of breathable, elastic material having inner and outer opposite surfaces and first and second opposite end edges, the first end edge of the wrap being secured to one of the inner and outer edges of the rear opening of the glove so as to extend rearwardly from the glove and at an acute angle relative to the rear opening thereof; and means for fastening the second end edge of the wrap to the outer surface thereof.

9. A wrist support glove according to claim 8 in which the first edge of the wrap is attached to the inner edge of the rear opening of the glove.

10. A wrist support glove according to claim 9 in which the wrap is a rectangular length of fabric and is attached to the inner edge of the rear opening of the glove at an angle from 60 to 80 degrees.

11. A wrist support glove according to claim including partial finger coverings.

12. A wrist support glove according to claim 1, in which the partial finger coverings include parcels of expandable, open mesh fabric.

13. A wrist support glove according to claim 12 in which the portion of the glove material covering the panel includes additional layers of material to form a cushioning pad.

14. A wrist support glove according to claim 13 in which the glove section is formed of an inner panel formed of leather and an outer panel including leather and open mesh material.

15. A wrist support glove according to claim 14 in which the outer panel of the glove includes a longitudinal slit and releasable means for securing the edges of the slit.

* * * * *